US005743438A

United States Patent [19]

Sokolnicki

[11] Patent Number: 5,743,438

[45] Date of Patent: Apr. 28, 1998

[54] UNDER SHELF RACK FOR WATER CONTAINER

[76] Inventor: Edward L. Sokolnicki, 217 Sunnybrook Rd., Jackson, N.J. 08527

[21] Appl. No.: 597,103

[22] Filed: Feb. 6, 1996

[51] Int. Cl.[6] ..... B67D 5/06

[52] U.S. Cl. ..... 222/181.1; 211/74; 211/113

[58] Field of Search ..... D7/397, 619; D6/512, D6/513; 211/74, 113; 248/320, 311.2, 318; 222/146.6, 179.5, 181.1, 181.2, 181.3

[56] References Cited

U.S. PATENT DOCUMENTS

| | | | |
|---|---|---|---|
| D. 162,122 | 1/1951 | Broeren | 248/311.2 X |
| 1,857,522 | 5/1932 | Ungeheuer . | |
| 1,916,202 | 7/1933 | Bubien . | |
| 1,950,133 | 3/1934 | Blood | 222/181.1 X |
| 2,005,939 | 6/1935 | Hibbard, Jr. | 211/113 X |
| 2,008,315 | 7/1935 | Schmidt | 211/113 X |
| 2,275,703 | 3/1942 | Trester et al. | 222/181.3 X |
| 3,458,243 | 7/1969 | Gefroh . | |
| 3,627,399 | 12/1971 | Addison et al. . | |
| 3,694,046 | 9/1972 | Gehrmann . | |
| 3,814,293 | 6/1974 | Daves | 211/74 X |
| 3,978,988 | 9/1976 | Friedeberg | 211/113 |
| 4,143,784 | 3/1979 | Frahm et al. . | |
| 4,597,616 | 7/1986 | Trubiano | 211/113 X |
| 4,653,818 | 3/1987 | DeBruyn | 211/113 X |
| 4,700,849 | 10/1987 | Wagner | 211/113 X |
| 5,251,975 | 10/1993 | Braun et al. . | |
| 5,323,917 | 6/1994 | Johnson et al. | 211/74 |

*Primary Examiner*—Kenneth Bomberg
*Attorney, Agent, or Firm*—Richard C. Litman

[57] ABSTRACT

An under shelf rack is adapted to hold a two and one half gallon disposable container of bottled water therein, and provides for efficient dispensing and drainage of the water therein with a sloped floor panel. The rack has a generally U-shaped configuration, with an inwardly or outwardly disposed mounting flange along each upper edge. The flanges may be used to mount the rack permanently beneath a cabinet or other generally horizontal surface, using bolts or other suitable fasteners, or alternatively may be removably mounted using complementary channels mounted to the underside of the mounting surface. The rack may be formed of a durable metal, plastic, or other suitable material, or may alternatively be formed of a light, thin, economically disposable plastic material which may be provided with and discarded with the water container. The interior surface may include a non-slip material thereon, to reduce the chance of slippage of a container therefrom. While the present rack is particularly suitable for use with disposable plastic bottled water containers, it may be adapted for use with other articles as well.

9 Claims, 3 Drawing Sheets

UNDER SHELF RACK FOR WATER CONTAINER

BACKGROUND OF THE INVENTION

1. Field of the Invention

The present invention relates to storage racks and the like adapted for particular uses, and more particularly to a storage and dispensing rack adapted to hold a two and one half gallon container of bottled water therein. The present rack includes a slight slope formed therein, thus providing for efficient drainage of a container placed therein. The rack may be permanently or removably affixed beneath a shelf, cabinet, or other structure, or may be suspended from a wire refrigerator shelf or the like, if desired. The rack may be formed of durable materials for long term use, or may be formed of a disposable plastic material similarly to many bottled water containers.

2. Description of the Prior Art

The use of bottled water has become ever more popular, and in fact at least from time to time is considered an essential commodity in many areas due to contamination of the water supply, chemical impurities, etc. Many persons just do not care for the taste of many chemical additives in their water supply, and accordingly purchase bottled water for drinking.

Most persons keep such jugs or containers of bottled water in a refrigerator, along with other chilled liquids (milk, soft drinks, etc.). The water container is normally placed upon one of the racks or shelves in the refrigerator, where it takes up a considerable amount of shelf space. Still, such containers of potable liquids are conventionally placed directly atop a shelf or the like, where they may be conveniently removed or liquid may be dispensed from them as desired. The lost shelf space may be acceptable for those who wish to have chilled water available, but in many cases, water at ambient or room temperature is preferred by many individuals. Thus, a container of bottled water must be left out on a table, counter, or other available surface, where it takes up valuable space.

While numerous racks and the like have been developed in the past for various purposes, including the holding of a container of liquid, none have been developed having a structure which provides specifically for the holding of a two and one half gallon container of water, suspended from an overhead shelf or rack, as provided by the present invention. Moreover, none provide a rack floor having a slope adapted to provide for efficient drainage of a water bottle or container placed therein, as provided by the present invention. A discussion of the specific features and limitations of related devices of the prior art which are known to the present inventor, is presented immediately below.

U.S. Pat. No. 1,857,522 issued to Ernest W. Ungeheuer on May 10, 1932 describes a Container For Tables, which container is primarily adapted to be suspended beneath a drafting table and to provide for the storage of drawings and the like therein. Accordingly, the device has a hinged door at its forward end, which would make access to another container stored therein, somewhat inconvenient. While Ungeheuer provides adjustable suspension means for his container, in order to adjust the angle thereof, the function of this adjustment means is precisely opposite the slope provided in the present rack. Ungeheuer's container has no inherent slope per se, and the adjustment is to accommodate the slope (if any) of the drafting table, in order to keep the container and its floor, level, as indicated on p. 2, l. 26 & 27 of the Ungeheuer disclosure. The present rack is adapted for installation beneath a level surface, but with a built in slope in the floor of the rack for drainage of a container placed therein.

U.S. Pat. No. 1,916,202 issued to Stanley Bubien on Jul. 4, 1933 describes a Shelf Support, comprising a telescoping structure having a generally U-shaped cross section, with a flat end plate. The device is mounted beneath a table or the like, with the end plate serving as a shelf for articles placed thereon. No slope in the end plate (which becomes the floor, as the device is mounted) is provided, as the device is adapted for the upstanding placement of articles therein, and any slope could lead to their falling from the open front of the relatively narrow device.

U.S. Pat. No. 3,458,243 issued to Ambrose P. Gefroh on Jul. 29, 1969 describes a Swingout Undercounter Container Holder adapted to be secured to the inside of a hinged cabinet door. The periphery of the frame is a quarter circular member which slides on a pad in the cabinet as the door is opened. Thus, the device is supported from below, rather than from above, as in the present rack. Gefroh makes no mention of any slope provided in his rack, for the drainage of any article placed therein.

U.S. Pat. No. 3,627,399 issued to Eugene B. Addison et al. on Dec. 14, 1971 describes a Portable Cooler And Support For A Pressurized Keg, comprising a lightweight box-like chest formed of a foam plastic material or the like. The device is much like conventional portable coolers and ice chests, with the exception of a removable circular panel on the front, through which the end of a beer keg or the like may be placed from within the box. The keg is supported in a level position by a rearwardly disposed support. This support does not tilt the container, but rather imparts some slight forward thrust to seal the end of the container within the front opening. Such containers having their own tapping system do not require any tilt for drainage, as they customarily include an internal line to the bottom of the container.

U.S. Pat. No. 3,694,046 issued to Hasso Gehrmann on Sep. 26, 1972 describes a Space Saving Kitchen Unit having various components and appliances pivotally mounted on vertical poles. No mention is made of a rack installed beneath a shelf for the storage of a container of bottled water or the like, therein.

U.S. Pat. No. 4,143,784 issued to Carl E. Frahm et al. on Mar. 13, 1979 describes a Water Bottle And Its Storage Case, with the case being adapted particularly for storage of a five gallon water bottle having an axially concentric neck and spout. The case includes opposite inward flanges at the front opening, to preclude the bottle from sliding from the case. No disclosure is made of any slope or tilting of the case for drainage of the bottle, as the case is intended strictly for storage of the bottle therein, rather than to provide for the dispensing of water from the bottle while in the case. In fact, Frahm et al. specifically teach away from any slope to their case, by providing specific means to retain the bottle in the case; any slope to the floor of the case would reduce the security of the bottle within the case, which Frahm et al. specifically wish to ensure.

Finally, U.S. Pat. No. 5,251,975 issued to Thomas F. Braun et al. on Oct. 12, 1993 describes an Extendible And Retractable Undercounter Container Assembly For Recyclable Materials. Multiple bins are provided, which slide outward from beneath a cabinet or the like by means of conventional drawer slides or similar. The only sloped components provided are cooperating upper edges of the bin assembly and a cover contained under the counter, with closure of the bins resulting in the upper edge of the bins being wedged tightly beneath the sloped lid for sealing. No disclosure is made of a sloped bottom surface for drainage of anything placed therein.

None of the above inventions and patents, either singly or in combination, is seen to describe the instant invention as claimed.

SUMMARY OF THE INVENTION

Accordingly, it is a principal object of the invention to provide an improved under shelf rack for a liquid container adapted for mounting beneath a cabinet, shelf, or other horizontal surface and to provide dispensing access to a liquid container therein.

It is another object of the invention to provide an improved rack which includes a slope in the floor portion, thereby providing for efficient draining of liquid in a container placed in the rack.

It is a further object of the invention to provide an improved rack which may be permanently secured beneath an overlying surface, or which may alternatively be removably secured, as desired.

An additional object of the invention is to provide an improved rack which may be formed of metal or other durable material, or which may alternatively be formed of a light and thin plastic or other economically disposable material.

Still another object of the invention is to provide an improved rack which may include non-slip material having a high coefficient of friction on the internal surfaces thereof, to preclude slippage of a water container or the like stored therein.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
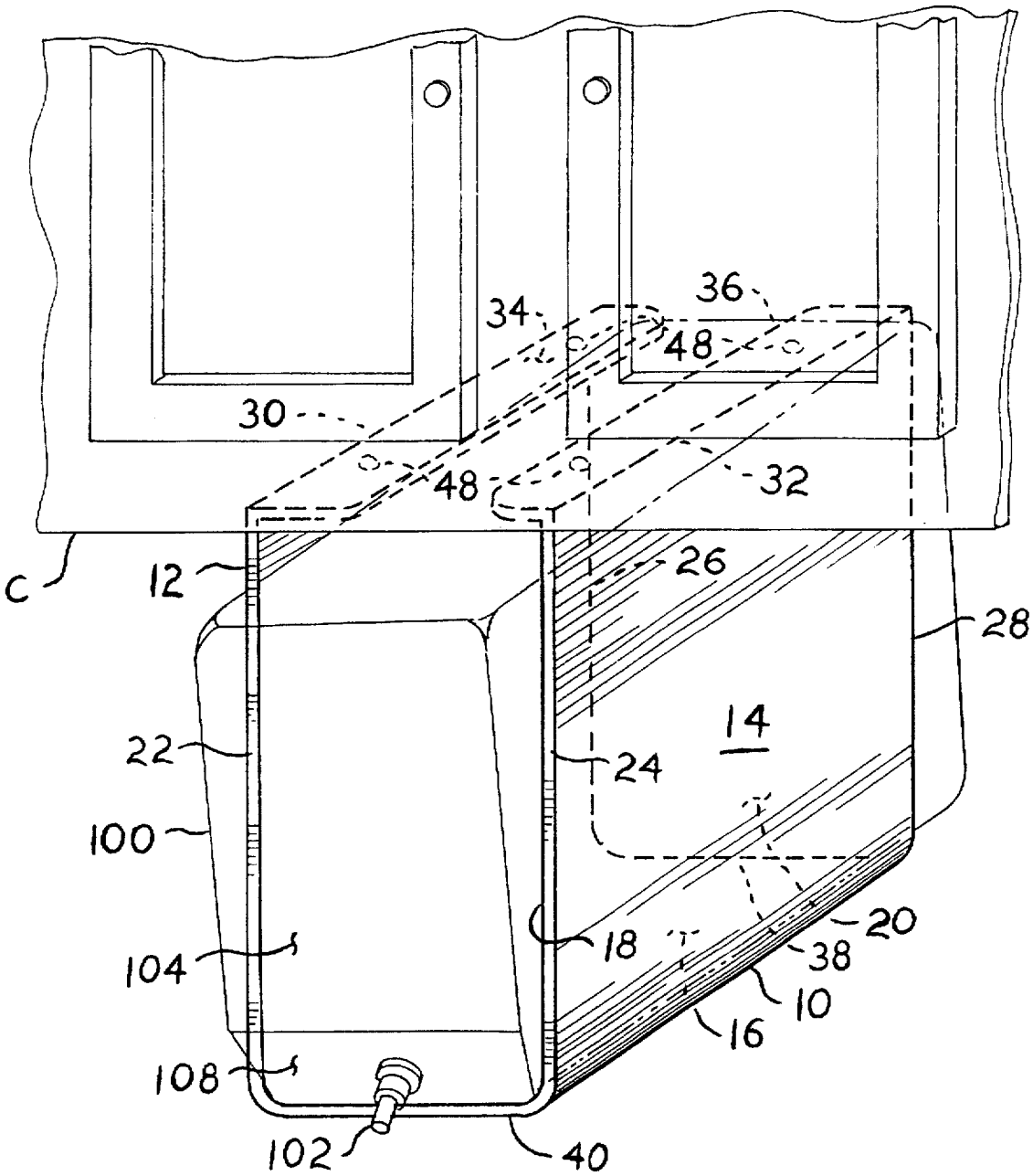
FIG. 1 is a front and side perspective view of the under shelf rack of the present invention, showing its installation beneath a cabinet and with a disposable water container placed therein.
Figure 2:
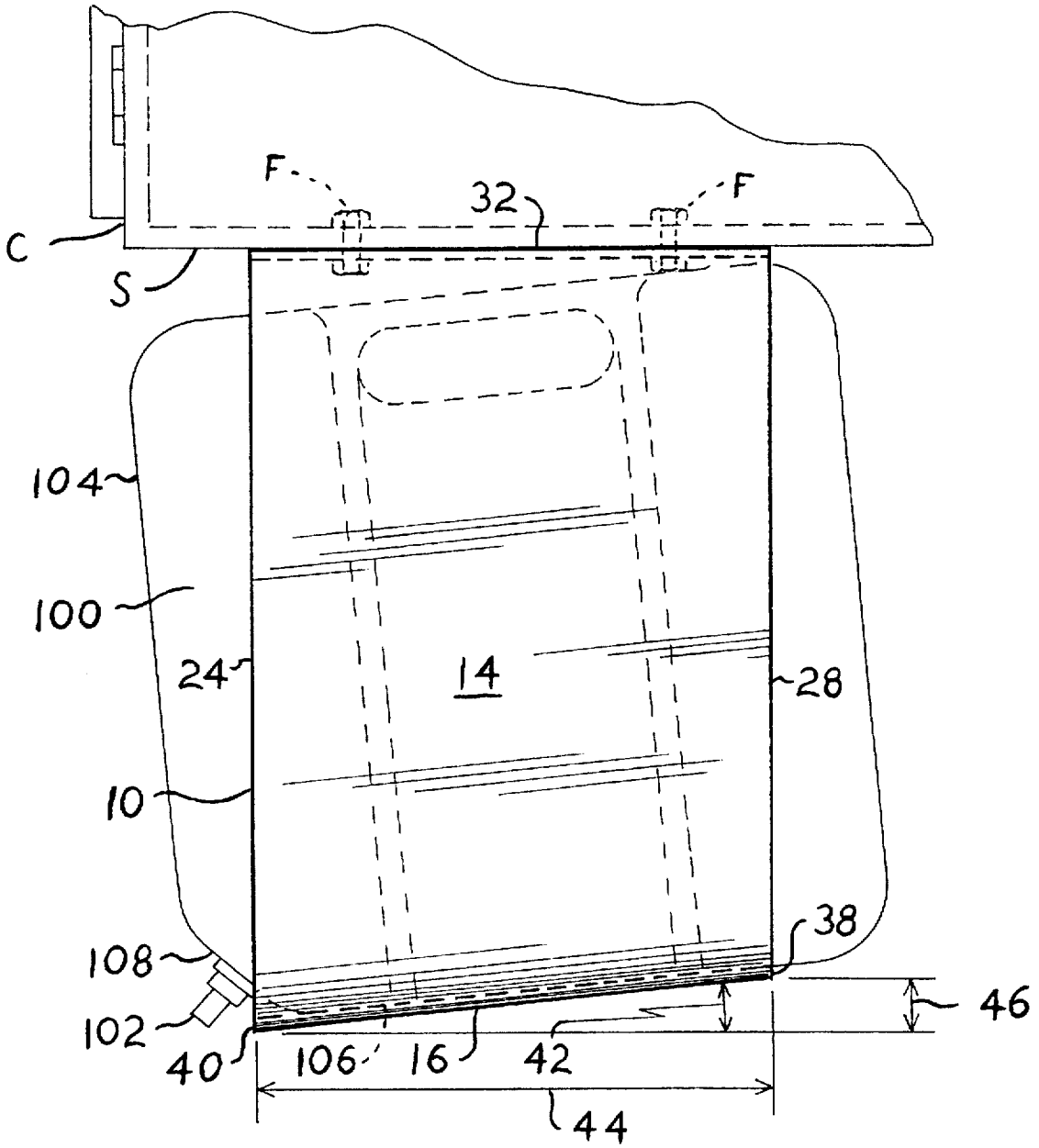
FIG. 2 is a side elevation view of the rack of FIG. 1, showing the slope of the floor of the rack to provide for more efficient drainage of a water container placed therein.

Referring now particularly to FIGS. 1 and 2 of the drawings, the present invention will be seen to comprise an under shelf rack 10 providing for the storage and accessible dispensing of a liquid from a liquid container 100. The present rack 10 is particularly adapted for the storage of containers 100 having a generally rectangular parallelipiped configuration, as shown in the drawing figures, and used for the transport, sale, and home storage of potable water, i. e., "bottled" water. While this is the primary function of the present rack 10, it will be seen that the rack 10 is adaptable for the storage of other types of containers as well.

Accordingly, the rack 10 is formed of a single flat, thin sheet of material to have a generally U-shaped configuration, with a first side 12, an opposite second side 14 generally parallel thereto, and a bottom panel 16 extending between the two. The junctures between each side 12/14 and the floor 16 may be smoothly rounded to preclude sharp edges, and to fit closely the typically rounded edges of containers 100 to which the present rack 10 is adapted. The generally U-shaped configuration of the rack 10 results in the forward and rearward ends, respectively 18 and 20, being open, thus allowing an object to be passed therethrough.

It will be noted particularly in FIG. 2 that the floor panel 16 is sloped downwardly and forwardly toward the front open end 18 of the rack 10. Specifically, the height of the two front edges 22 and 24 respectively of the first and second side panels 12 and 14, is taller than the height of the two rear edges 26 and 28 of those panels 12 and 14. (The two side panels 14/16, and thus their respective heights and other dimensions, are equal to one another.) The upper edges 30 and 32 of the rack 10, with their mounting flanges 34 and 36 extending horizontally therefrom, provide a horizontal reference for the rack 10 when it is mounted to a generally horizontal overlying surface, such as the bottom shelf S of the cabinet C of FIGS. 1 and 2. This results in the rear edge 38 of the floor panel 16 being higher than the front edge 40, to provide a downward slope, indicated as 42 in FIG. 2, toward the front of the rack 10 for efficient flow and drainage of water or other liquid from a container 100 placed within the rack 10.

While the present rack 10 may be formed to virtually any practicable dimensions, it has been found that a length 44 on the order of eight inches and a height difference 46 on the order of half an inch, to produce a slope 42 of one in sixteen, or six and one quarter percent, works well for the typical two and one half gallon water container for which the present rack 10 is especially adapted. Thus, the present rack 10 may be mounted directly to the underside of a horizontal surface, such as a shelf S, with the slope 42 of the floor panel 16 providing good flow of the water or other liquid within a container 100 stored therein, without need for labor intensive shimming or spacing of the two mounting flanges 34 and 36 to other than a horizontal mounting, or other means of providing a slope for the floor 16.

It will be noted that the two flanges 34 and 36 are disposed inwardly from their respective sides 12 and 14. These flanges 34/36 may also be provided with a plurality of mounting holes 48, through which bolts (e. g., carriage bolts, flat head bolts, etc.) or other fasteners F may be installed to secure the present rack 10 to an underlying shelf S. However, the flanges may be bent or otherwise formed outwardly from the sides 12 and 14, as in the alternative flange 50 shown in broken lines in FIG. 3.

Figure 3:
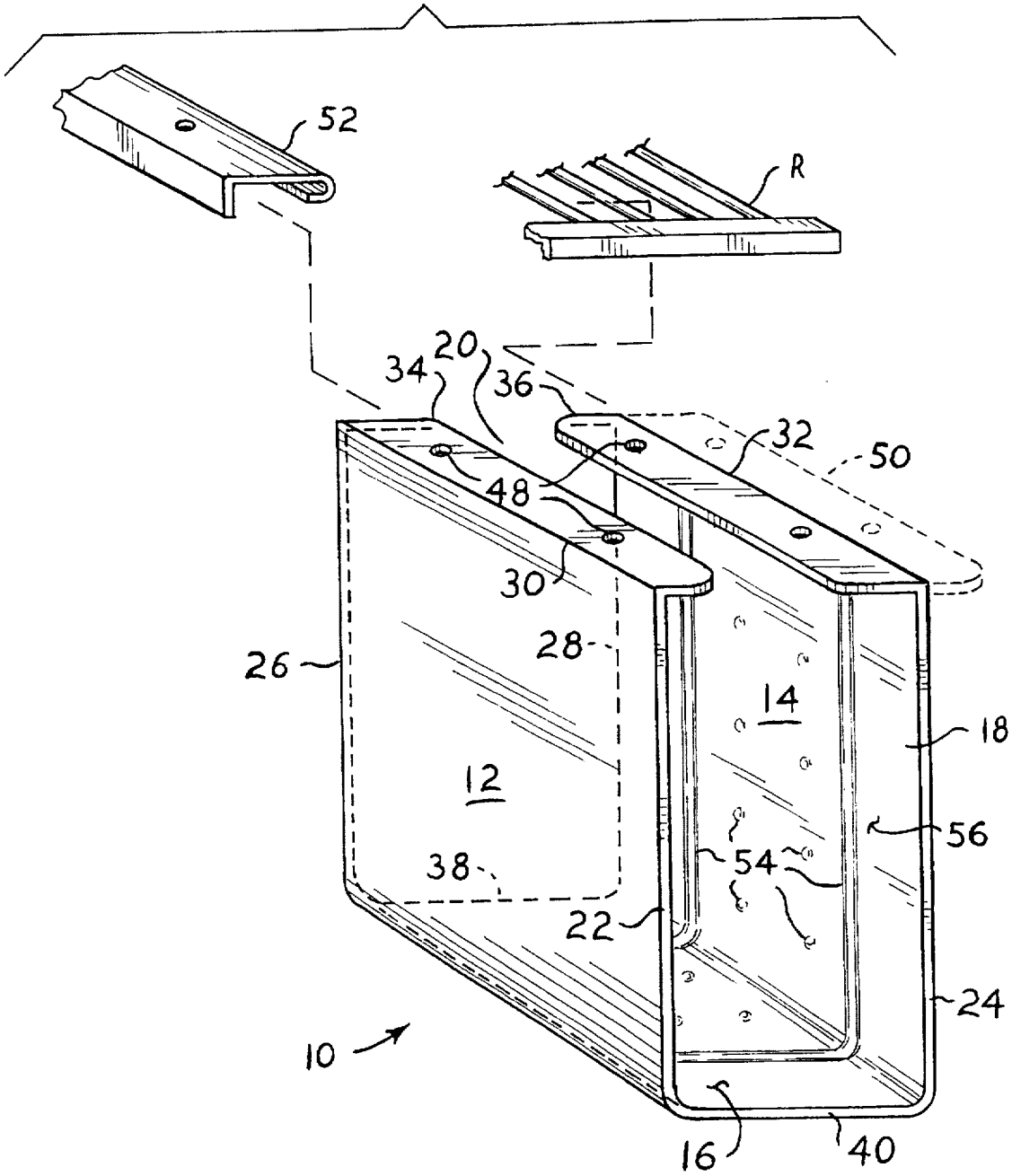
FIG. 3 is an exploded perspective view of the present rack, showing removable mounting means, an alternative mounting flange configuration, and non-slip material disposed upon the inner surface of the rack.

FIG. 3 also discloses an alternative mounting arrangement for the present rack 10. While generally it is anticipated that the rack 10 may be formed of metal or a durable plastic material for a permanent installation, the rack 10 may alternatively be formed of a relatively thin and light plastic material, if desired, in the same manner as the various "poly" plastics used to form water containers such as the container 100. These containers are relatively inexpensive and economically disposable, particularly with various recycling programs available. The rack 10 could be manufactured in a similar manner, and sold or provided with the water container 100 at the point of sale, and later discarded or recycled with the depleted container 100.

Accordingly, an alternative temporary mounting means is shown in FIG. 3 of the drawings. A pair of channels 52 (one of which is shown) may be permanently secured beneath a shelf or other location and parallel to one another, spaced to provide for the removable insertion of the inwardly disposed rack flanges 34/36 or the alternative outwardly disposed flanges 50 therein. (Fastener holes 48 may or may not be provided for such a removable rack.) The disposable rack 10 and a container 100 placed therein, may be slipped into the channels 52 by means of the flanges 34/36/50 and later removed for replacement when the container 100 is depleted.

The use of inwardly disposed flanges 34/36, or outwardly disposed flanges 50, provides additional mounting possibilities for the present rack 10. While it is primarily intended that the present rack 10 be used to store a water container so as to provide water at ambient or room temperature, the rack 10 may be suspended from a refrigerator wire rack R by means of hooking the flanges 34/36/50 over the wires, so a container 100 may be conveniently stored to provide chilled water without taking up shelf space within the refrigerator.

The one in sixteen slope provided in the floor 16 of the present rack 10, is sufficiently steep as to provide good drainage of a container 100 placed therein, while still being sufficiently shallow that such a container 100 is not likely to slip from the rack 10. However, additional insurance against such slippage may be provided by means of a non-slip material 54 disposed at least partially over the inner surface 56 of the rack 10. While the entire inner surface 56 could be coated with such material, a partial coating in the form of a plurality of spaced apart dots and/or lines of the material 54, is generally sufficient. A soft, flexible and pliable silicone sealant material has been found to work well, and other rubberized coatings or materials having a relatively high coefficient of friction may also be used.

While the present rack 10 may be formed in various dimensions and configurations adapted for storage of a variety of containers and other articles, it is particularly well adapted for the placement and storage of a disposable two and one half gallon capacity plastic container of bottled water. Typically, such containers, e. g., container 100, have a rectangular parallelipiped configuration with dimensions on the order of ten inches long by ten inches tall by six inches wide or thick, although these dimensions may vary somewhat according to the manufacturer of the container. Such containers 100 are also generally provided with a spigot or spout 102 extending from a dispensing end 104, but offset to lie adjacent to the adjoining bottom surface 106. The edge 108 where the spigot 102 is located, may be truncated as shown.

The present rack 10 is temporarily or permanently installed as discussed above, i. e., bolted or otherwise secured beneath a shelf S or cabinet C, removably slipped into position into a pair of channels 52, suspended from a wire rack R, etc. The longer front edges 22 and 24 are positioned so that they are readily accessible, i. e., so the slope 42 is oriented downwardly toward the front of the cabinets C, toward the conventional position of a user of the rack 10. A water container 100 or other liquid container compatible with the dimensions of the present rack 10, is then removably placed within the rack 10, with any spigot, tap or the like positioned adjacent the front edge 40 of the floor panel 16 of the rack 10, i. e., at the lowest point of the rack 10. The opposite rearward portion of the container 100 will thus be slightly higher due to the slope 42 of the floor 16, to provide efficient dispensing and drainage of water or other liquid from the container 100.

When the container 100 is depleted, it is easily slipped from the rack 10 and discarded, with a fresh container 100 replacing the depleted one. Alternatively, the entire rack 10 may be removed from any temporary mounting means (e. g., channels 52 or a refrigerator rack, etc.) and discarded with the depleted container 100, when such a rack 10 is formed of inexpensive and economically disposable materials.

Thus, the present rack 10 will be seen to provide an efficient means of storing a water container 100 or the like for ready use, without taking up valuable shelf or counter space in the home or other location. The user is provided with water from such a water container 100 at room temperature, which to many users is preferable to chilled water stored in a refrigerator. However, the present rack 10 may be suspended from a refrigerator rack R, as described above, if desired. In any case, by using space which is otherwise wasted beneath a cabinet or shelf, the present rack 10 provides exceptional convenience for persons who use bottled water, and will be a valuable addition to other articles and appliances in the kitchen or elsewhere.

It is to be understood that the present invention is not limited to the sole embodiment described above, but encompasses any and all embodiments within the scope of the following claims.

I claim:

1. A liquid dispensing apparatus comprising:

a storage rack adapted for installation beneath a generally horizontal overlying surface and formed of a generally U-shaped thin sheet of material having a generally vertical and flat first side including a first front side edge, an opposite first rear side edge and a generally horizontal first upper edge; an opposite generally vertical and flat second side generally parallel to said first side, said second side including a second front side edge, an opposite second rear side edge, and a generally horizontal second upper edge; a generally flat floor panel extending between said first side and said second side, said floor panel including a front floor edge and a rear floor edge; a first mounting flange extending generally horizontally from said first upper edge; and a second mounting flange extending generally horizontally from said second upper edge; said first rear side edge substantially equal in length to said second rear side edge, said first front side edge substantially equal in length to said second front side edge, with each said first and second side edge longer than each said first and second rear side edge to provide a downward and forward slope to said floor panel; said first front side edge, said second front side edge, and said front floor edge defining a forward unobstructed open end; and said first rear side edge, said second rear side edge, and said rear floor edge defining an opposite rearward unobstructed open end;

each said side and said floor panel including an inner surface with a non-slip material having a high coefficient of friction disposed over at least a portion thereof; and a liquid container having a generally rectangular parallelipiped configuration with a bottom surface and a dispensing spigot end with an offset dispensing spigot extending therefrom and adjacent to said bottom surface; whereby said liquid container is removably placed within said storage rack with said offset dispensing spigot disposed adjacent said forward open end and adjacent said floor panel of said rack and said downward and forward slope of said floor panel providing for efficient drainage of liquid from said liquid container as the liquid is depleted.

2. The storage rack and liquid container combination according to claim 1, wherein:

each said mounting flange of said rack extends inwardly from each respective said upper edge of each said side.

3. The storage rack and liquid container combination according to claim 1, wherein:

each said mounting flange of said rack extends outwardly from each respective said upper edge of each said side.

4. The storage rack and liquid container combination according to claim 1, wherein:

said downward and forward slope of said floor panel of said storage rack is substantially six and one quarter percent.

5. The storage rack and liquid container combination according to claim 1, wherein:

said rack is adapted to be permanently mounted to the overlying surface, with each said mounting flange including a plurality of fastener holes therein.

6. The storage rack and liquid container combination according to claim 1, including:

a first and an opposite second mounting flange channel adapted to be permanently mounted to the overlying surface, with said rack being adapted to be removably mounted to the overlying surface by means of each said mounting flange being slidably installable and removable in a respective said mounting flange channel.

7. The storage rack and liquid container combination according to claim 1, wherein:

said rack is formed of sheet metal.

8. The storage rack and liquid container combination according to claim 1, wherein:

said rack is formed of sheet plastic material.

9. The storage rack and liquid container combination according to claim 1, wherein:

said rack and said liquid container are each formed of economically disposable material.

* * * * *